US006618946B2

(12) United States Patent
Seraphin

(10) Patent No.: US 6,618,946 B2
(45) Date of Patent: Sep. 16, 2003

(54) KNIFE

(75) Inventor: Marc Seraphin, Villard sur Doron (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/009,517

(22) PCT Filed: Apr. 12, 2001

(86) PCT No.: PCT/FR01/01139

§ 371 (c)(1),
(2), (4) Date: Dec. 11, 2001

(87) PCT Pub. No.: WO01/76831

PCT Pub. Date: Oct. 18, 2001

(65) Prior Publication Data

US 2002/0157261 A1 Oct. 31, 2002

(30) Foreign Application Priority Data

Apr. 12, 2000 (FR) ..... 00/04713

(51) Int. Cl.[7] ..... B26B 1/02
(52) U.S. Cl. ..... 30/160; 30/158; 30/161
(58) Field of Search ..... 30/158, 159, 160, 30/161, 155

(56) References Cited

U.S. PATENT DOCUMENTS

| | | | | | |
|---|---|---|---|---|---|
| 2,824,368 A | | 2/1958 | Bassett | 30/161 |
| 4,087,911 A | * | 5/1978 | Schrock et al. | 30/286 |
| 4,177,560 A | * | 12/1979 | Sakurai | 30/160 |
| 5,502,895 A | * | 4/1996 | Lemaire | 30/158 |

FOREIGN PATENT DOCUMENTS

| | | |
|---|---|---|
| EP | 0 100 377 A1 | 2/1984 |
| WO | WO 99/58302 | 11/1999 |

* cited by examiner

*Primary Examiner*—Hwei-Siu Payer
(74) *Attorney, Agent, or Firm*—Oliff & Berridge, PLC

(57) ABSTRACT

A hand-held jack-knife according to the invention essentially comprises a blade and a handle articulated around an axis of rotation. This articulation is formed by a hollow bush the axial opening thereof passes completely through the handle and which is fixedly secured in rotation to the table. The blade can be operated by means of knobs. A stop catch may be formed by a tab, the free end of which may engage in housings of the bush-knob system. This knife finds its application in the fields of, for example, mountain climbing, pot-holing, deep-sea fishing, water and aerial sports.

15 Claims, 3 Drawing Sheets

FIG 1
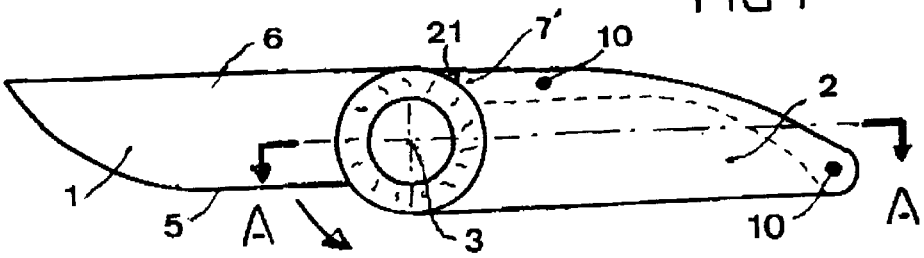
FIG 2
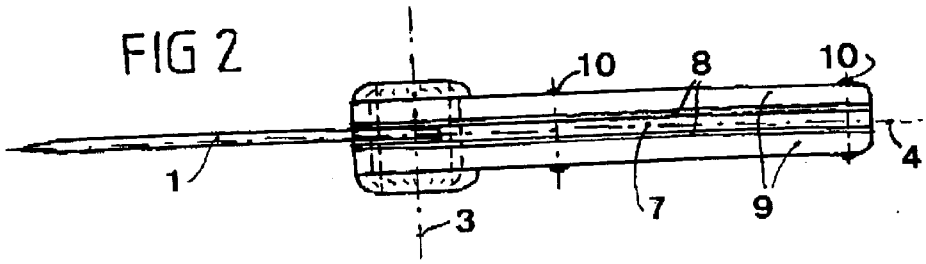
FIG 3
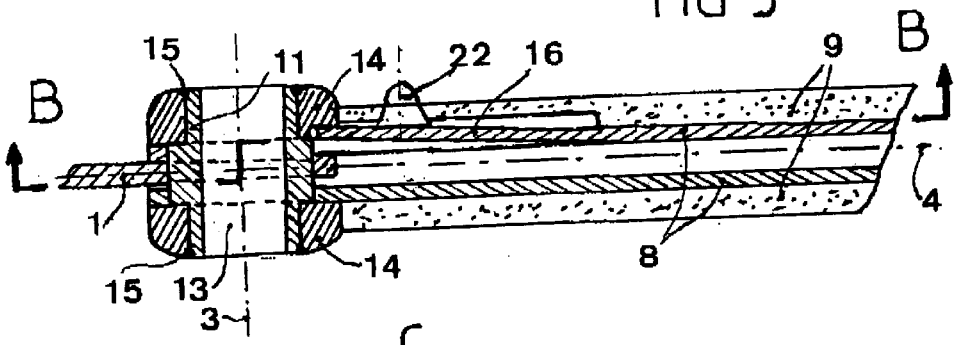
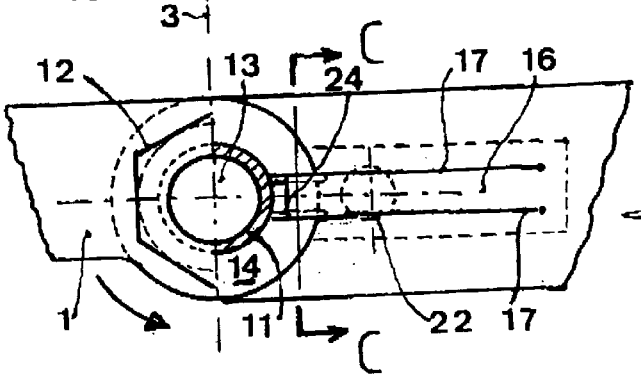
FIG 4
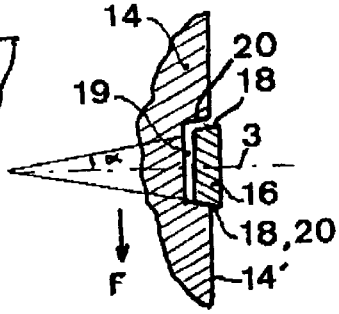
FIG 5

KNIFE

STATE OF THE ART

The invention relates to hand-held jack-knives, provided with slop catches or not.

Numerous embodiments of such knives are known, but the use thereof in certain fields of activity requires them to be attached to their user by means of a suitable attachment means; this is the case in particular for the field of mountain climbing, pot-holing, deep-sea fishing, water and aerial sports, etc. In other circumstances, they have to be fixed or attached to a fixed support, for example for presentation, and maybe for theft prevention purposes, on a stand.

It is of course sufficient to drill a hole in the handle of said knives to meet this requirement, but this hole that has to be sufficiently large for the attachment to pass through (for example a mountaineering snap-hook) has to be placed on an extension of the handle so as not to hamper full closing of the blade and has to be of a diameter appreciably smaller than the largest transverse dimension of said handle. The invention proposes to overcome this difficulty without increasing the longitudinal dimension of the knife.

In the following description, we will designate by:

longitudinal plane of the knife: a plane parallel to the mid-plane of the blade.

longitudinal direction of the knife: a direction parallel to the longitudinal plane extending appreciably from the free end of the handle to the free end of the blade, the knife being in the open position.

OBJECT OF THE INVENTION

A knife according to the invention is therefore essentially formed by a handle and a blade articulated around an axis of rotation. This articulation is formed by a hollow bush, the axial opening thereof perpendicular to the longitudinal plane of the knife and the dimension thereof adapted to the size of the attachment or of the fixing means used, passes completely through the handle and is secured in rotation to the knife blade. This opening may be of cylindrical shape but will preferably have a tapered shape towards the outside, for example in the form of a half-ring. This shape makes it easier to insert the attachment or adapts better to fit the curvature of the fixing means (padlock bow, mountaineering snap-hooks).

This bush is generally fixedly secured in rotation to at least one operating means, external to the handle, enabling the blade to be opened and closed.

This operating means is formed for example by one or two circular knobs. The knob is externally ribbed and/or presents raised external parts so as to be able to be operated easily with the thumb or another finger of one hand.

The stop catch is formed by at least one flexible tab. One end thereof is fixedly secured to the handle of the knife and the other, free end thereof, engages by spring effect in a suitable housing of the bush-knob assembly when the blade is fully open. This full opening is determined by the heel of the blade pressing on a stop placed in the handle of the knife.

The tab is either flexible or rigid and articulated at its base around an axis of rotation appreciably parallel to the longitudinal plane of the knife and subjected to the action of a flexible means (spring, elastomer, etc.) acting towards the outside.

The tab presents a flat and elongate shape in the active part thereof; the length of the tab is arranged either in an appreciably radial direction or in an appreciably tangential direction with respect to the rotation movement of the blade on the handle.

The housing situated in the bush-knob assembly presents, in a cross-section parallel to the axis of rotation and in a tangential direction with respect to the rotation movement, the shape of a straight prism of trapezoid cross-section the large base thereof is directed towards the end of the tab. The bearing plane on the end of the tab presents an incline of 8° and 12° with respect to the axis of rotation.

This arrangement enables the blade to be locked in the open position of the knife and enables any mechanical play due to machining and initial assembly tolerances and/or wear of the moving parts in use to be compensated. The bearing planes of the end of the tabs preferably present the same incline.

The spring effect of the tabs is exerted outwards, the end housing being preferably situated on the internal face of the knob parallel to the longitudinal plane of the knife.

To release the stop catch and close the blade, one or two push-buttons can be provided in the handle to push the tab outwards and thus allow the blade—bush—knob assembly to rotate with respect to the handle.

It should be noted that the tab can also be used, the knife blade being in the closed position, to create a hard friction preventing the blade from opening accidentally. In this case, a housing in the form of a trapezoid prism, similar to that of the stop catch, is also made in the bush-knob assembly but the incline thereof is 45° to 80° in order to enable the tab to be pushed inwards by a small opening force of the blade exerted on the knob or the blade.

BRIEF DESCRIPTION OF THE DRAWINGS

The invention will be better understood by means of the following example illustrated by the following figures;

FIG. 1: overview in elevation of the knife in the "open" position,

FIG. 2: top overview of the knife in the "open" position,

FIG. 3: cross-section view along the line AA of FIG. 1,

FIG. 4: cross-section view along the line BB of FIG. 3,

FIG. 5: detail in cross-section along the line CC of FIG. 4,

DESCRIPTION OF A PREFERRED EMBODIMENT

Figure 6:
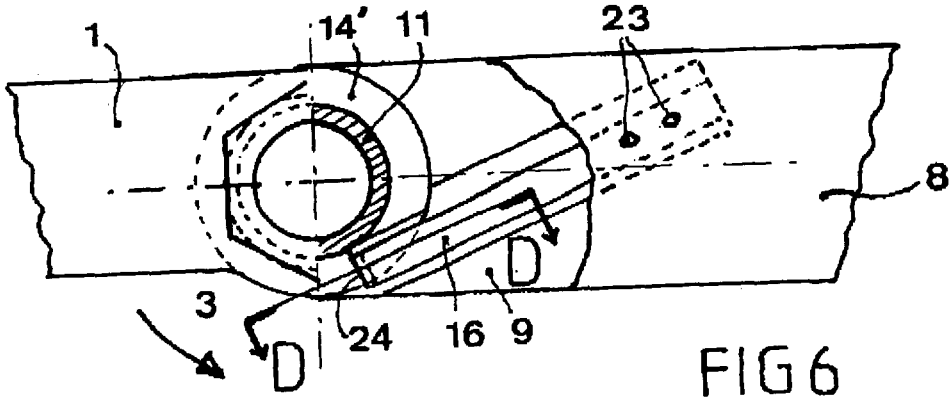
FIG. 6: alternative embodiment, cross-section view along the line BB of FIG. 3, FIG. 7: detail, cross-section view along the line DD of FIG. 6, FIG. 8: overview of a single-piece handle.
Figure 7:
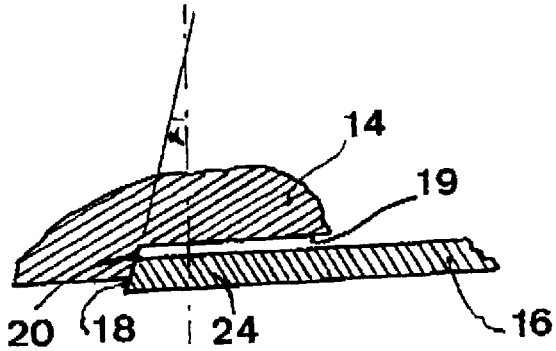

In all the figures, the curved arrow indicates the closing direction of the knife.

A knife according to the invention comprises a blade (1) and a handle (2) movable in rotation, and fitting smoothly with respect to one another around an axis perpendicular to the longitudinal plane (4) of the knife. The blade (1) is sharp on one of the sides (5) and presents a blunt edge (6) on the other side.

The handle comprises a spacer (7), two plates (8) made of steel plate and a coating (9) made of wood, horn, plastic or rubber material, etc. secured by rivets (10).

The articulation between the handle (2) and the blade (1) is formed by a steel bush (11) having in its middle a hexagonal periphery (12) perpendicular to the axis (3) which fits into a hexagonal opening of the knife blade (1).

Figure 9:
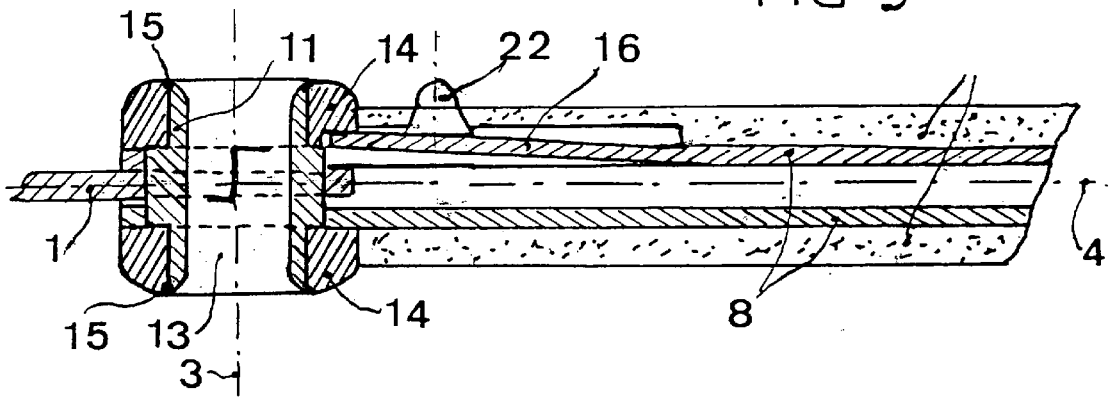
FIG. 9: cross-sectional view along the line of AA of FIG. 1, depicting a tapered opening.

A circular hole (13) is drilled in this bush (11) along the axis (3), which bush is joined to two steel knobs (14), this join being achieved by any known means such as welding, soldering, sticking, crimpling, fretting, etc. The weld (15) can be performed by means of a laser beam. The circular hole (opening) 13 may be of cylindrical shape but will preferably have a tapered shape towards the outside, for example in the form of a half-ring (FIG. 9). This shape makes it easier to insert the attachment or adapts better to fit the curvature of the fixing means (padlock bow, mountaineering snap-hooks).

A tab (16) is cut for example by laser along two grooves (17) in the plate (8), the upper one in FIG. 3; this tab is bent towards the outside of the knife and machined at its free end, as indicated in FIG. 5, along two inclined planes (18) forming an angle of 10° with the axis (3).

This tab (16), like the plate (8), is made of treated steel after shaping and machining, to give it the required elasticity.

The internal surface (14') of the knob (14) comprises a trapezoid prismatic housing. The generating lines thereof are appreciably parallel to the longitudinal direction of the knife (20) and the sides whereof form an angle of 10° with the axis (3).

When the blade (1) is fully opened out, the heel (21) thereof comes up against the stop formed by the end (7') of the spacer (7), and the free end of the tab (16) engages in the housing (19) of the knob (14) immobilizing the blade in this position and exerting a force (F) that compensates any play in the articulation.

The device is completed by a push-button (22) fixedly secured to the handle (2) that releases the fee end of the tab (16) from the housing (19) of the knob (14) by an inward pressure that releases the blade and enables the knife to be closed in the direction of the curved arrow.

The example relates to the case of a single tab (16) but the knife can comprise two tabs each situated in one of the plates (8), releasing the stop catch then requiring a double action in opposite directions on the two push-buttons.

This arrangement provides enhanced safety against involuntary or accidental release of the stop catch.

FIG. 6 represents an alternative embodiment of the stop catch. In this case, the flexible tab (16) is located inside the handle (2) and is affixed thereto, at its base, for example by two rivets (23). The tab (16) is arranged tangentially with respect to the movement of the blade and the free end (24) thereof beveled with an angle of 10°, engages in the housing (19) of the knob (14).

The free end (24) of the tab (16) is situated appreciably on a radius passing through the axis (3).

Figure 8:
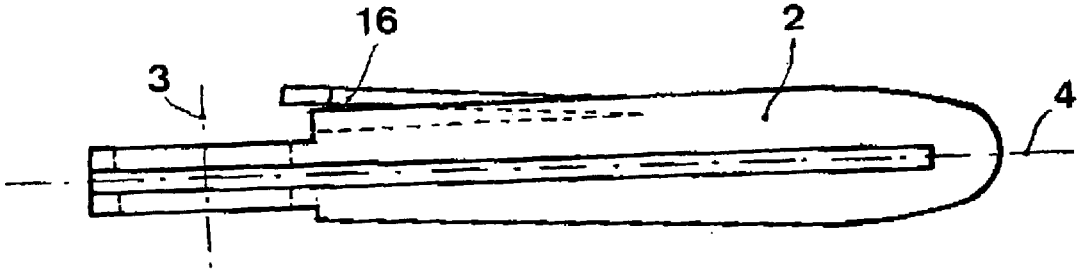

The handle can also be in a single piece (FIG. 8) and be made of metal or plastic materials, possibly reinforced with short fibers (glass, carbon) and obtained by molding, including the tab(s) (16).

In this case, the tabs are accessible from the outside of the handle.

A simple local pressure with a finger near to its free end close to the knob then releases the stop catch without using push-buttons.

In the case of reinforced plastic materials, and for a better elasticity of the tab, it is preferable that the latter be reinforced by long fibers arranged in the lengthwise direction thereof.

What is claimed is:

1. A jack-knife formed by a blade and a handle articulated on one another around an axis perpendicular to the longitudinal plane of the knife, the articulation being formed by a hollow bush, wherein the bush is fixedly secured to the blade of the knife so the bush and the blade rotate together relative to the handle, and the opening of the bush passes completely through the handle.

2. The knife according to claim 1, wherein the opening is of tapered shape towards an outside of the hollow bush.

3. The knife according to claim 1, wherein the hollow bush is provided with at least one operating means external to the handle enabling manual opening and closing of the blade.

4. The knife according to claim 3, wherein the operating means is formed by a circular knob.

5. The knife according to claim 4, wherein the knob is externally ribbed and/or presents external raised parts.

6. The knife according to claim 5, comprising a stop catch, wherein the stop catch is formed by at least one tab and one of the ends of the at least one tab forms part of the handle and the other free end thereof engages by spring effect in a corresponding housing of an assembly comprising the bush and the knob when the blade is fully open.

7. The knife according to claim 6, wherein:

the housing is situated on the internal face of the knob and presents, in cross-section parallel to an axis of rotation of the blade and in a direction tangential to the rotation movement of the blade, the shape of a straight prism with a trapezoid cross-section, the large base of the trapezoid is directed towards the free end of the at least one tab; and the bearing plane on the end of the at least one tab makes an angle of 8° to 12° with respect to the direction of the axis of rotation of the blade.

8. The knife according to claim 7, wherein the end of the at least one tab presents a complementary shape to that of the housing.

9. The knife according to claim 6, wherein the length of the at least one tab is arranged appreciably in the longitudinal plane of the knife in the longitudinal direction.

10. The knife according to claim 6, wherein the length of the at least one tab is arranged in the longitudinal plane of the knife and appreciably tangentially to the rotation movement of the blade.

11. The knife according to claim 6, wherein the free end of the at least one tab engages in a housing of the assembly with a bearing angle comprised between 45° and 80°, the blade being closed.

12. The knife according to claim 6, comprising at least one push-button enabling the stop catch to be released.

13. The knife according to claim 6, wherein the at least one tab is made of treated steel.

14. The knife according to claim 6, wherein the at least one tab is rigid, movable around its base, and acts towards the outside of the handle due to the effect of a flexible means.

15. The knife according to claim 6, wherein the at least one tab is made of plastic material, reinforced by long fibers (glass, carbon) arranged according to their length.

* * * * *